US007871288B1

(12) United States Patent
Lee

(10) Patent No.: US 7,871,288 B1
(45) Date of Patent: Jan. 18, 2011

(54) POWER CONNECTOR STRUCTURE

(75) Inventor: Chun-Te Lee, Taipei (TW)

(73) Assignee: Longwell Company, Taipei (TW)

( * ) Notice: Subject to any disclaimer, the term of this patent is extended or adjusted under 35 U.S.C. 154(b) by 0 days.

(21) Appl. No.: 12/714,802

(22) Filed: Mar. 1, 2010

(30) Foreign Application Priority Data

Dec. 16, 2009 (CN) ..... 2009 2 0273243 U

(51) Int. Cl.
*H01R 13/58* (2006.01)

(52) U.S. Cl. ..... 439/470

(58) Field of Classification Search ..... 439/447, 439/470

See application file for complete search history.

(56) References Cited

U.S. PATENT DOCUMENTS

| | | | | |
|---|---|---|---|---|
| 2,650,973 | A * | 9/1953 | Jacobi | 200/293 |
| 5,011,440 | A * | 4/1991 | Lee | 439/857 |
| 5,295,859 | A * | 3/1994 | Kawai et al. | 439/455 |
| 5,599,202 | A * | 2/1997 | Key | 439/459 |
| 6,537,103 | B2 * | 3/2003 | Jamison | 439/452 |
| 7,131,858 | B1 * | 11/2006 | Zerebilov | 439/446 |
| 7,186,133 | B1 * | 3/2007 | Szczesny | 439/446 |
| 7,488,196 | B2 * | 2/2009 | Kocher et al. | 439/457 |
| 7,507,108 | B2 * | 3/2009 | Tsuji | 439/446 |
| 2005/0032414 | A1 * | 2/2005 | Hoch et al. | 439/470 |
| 2007/0020990 | A1 * | 1/2007 | Nad | 439/470 |

* cited by examiner

*Primary Examiner*—Edwin A. Leon
*Assistant Examiner*—Larisa Tsukerman
(74) *Attorney, Agent, or Firm*—Mucny, Geissler, Olds & Lowe, PLLC

(57) ABSTRACT

A power connector structure is provided. The present invention includes a cable having a plurality of cores and each core provided with a terminal electrically connected thereto, an inner holder structure configured for fixing those cores and providing electricity isolation among those terminals, an inner case, a strain relief structure, and an external cover. The inner case has a main body and a plurality of out-extending positioned protrusions extending outwards from the edge of a side opening of the main body and towards the cable, wherein the out-extending positioned protrusions are disposed between those cores to separate those cores from each other. The strain relief structure is set on the side opening and substantially filled with the gap within the side opening, wherein the strain relief structure covers the out-extending positioned protrusions and a portion of the cable.

6 Claims, 7 Drawing Sheets

POWER CONNECTOR STRUCTURE

BACKGROUND OF THE INVENTION

1. Field of the Invention

The present invention relates to a power connector structure and more particularly to a power connector structure with good reliability.

2. Description of the Prior Art

Information electronic products become indispensable in daily life due to the prosperous development in multimedia industry, the rapid development of electronic technologies and the popularization of personal computers. The power of a general portable electronic device (e.g. a notebook) is supplied via a power cord and a power connector. Therefore, producers and developers pay much attention to the development of power connectors.

A conventional power connector has inner components including an inner case, an inner holder structure, terminals, and an external cover covering the inner components. An intersection between a power cord and the inner case is covered by a strain relief bushing to provide the electricity isolation. However, the inner case of the conventional power connector is merely a cap body, which means that the bonding force between the power cord and the inner case is weak; thereby a pulling test of the conventional power connector is usually failed.

SUMMARY OF THE INVENTION

The present invention is directed to providing a power connector structure. Utilizing out-extending positioned protrusions to enhance the bonding force between the inner case and the strain relief structure to improve the reliability of the product.

To achieve these advantages and the purpose of the invention, an embodiment of the power connector structure includes a cable, an inner holder structure, an inner case, a strain relief structure and an external cover. The cable has a plurality of cores, wherein the cores extend from a line end of the cable and each core is provided with a terminal electrically connected thereto. The inner holder structure is disposed at the line end for fixing the cores and providing electricity isolation among the terminals. The inner case is configured for containing the cores extending from the line end and the terminals, wherein the inner case including: a main body having a containing space with two side openings at both sides of the main body to receive the inner holder structure and the terminals; and a plurality of out-extending positioned protrusions disposed on the opening near the line end and extending outwards from the edge of the side opening and towards the cable, wherein the out-extending positioned protrusions are disposed between the cores to separate the cores from each other. The strain relief structure is set on the side opening near the line end and substantially filled with the gap within the side opening, wherein the out-extending positioned protrusions are covered by the strain relief structure. The external cover houses the inner case.

Other advantages of the present invention will become apparent from the following description taken in conjunction with the accompanying drawings wherein are set forth, by way of illustration and example, certain embodiments of the present invention.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
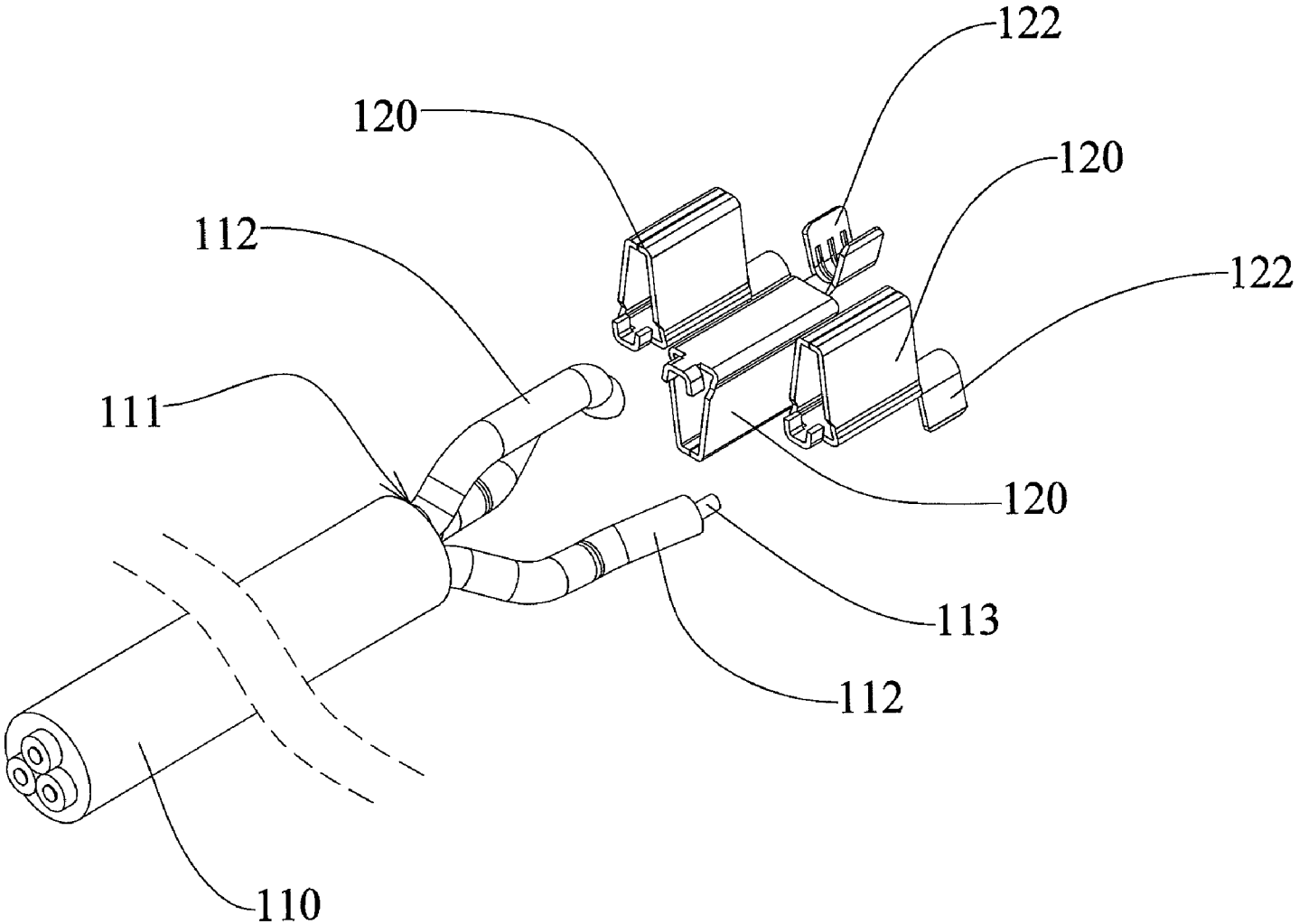
FIG. 1, FIG. 2, FIG. 3, FIG. 4, FIG. 5, FIG. 6 and FIG. 7 are assembling diagrams schematically illustrating a power connector structure according to one embodiment of the present invention.
Figure 2:
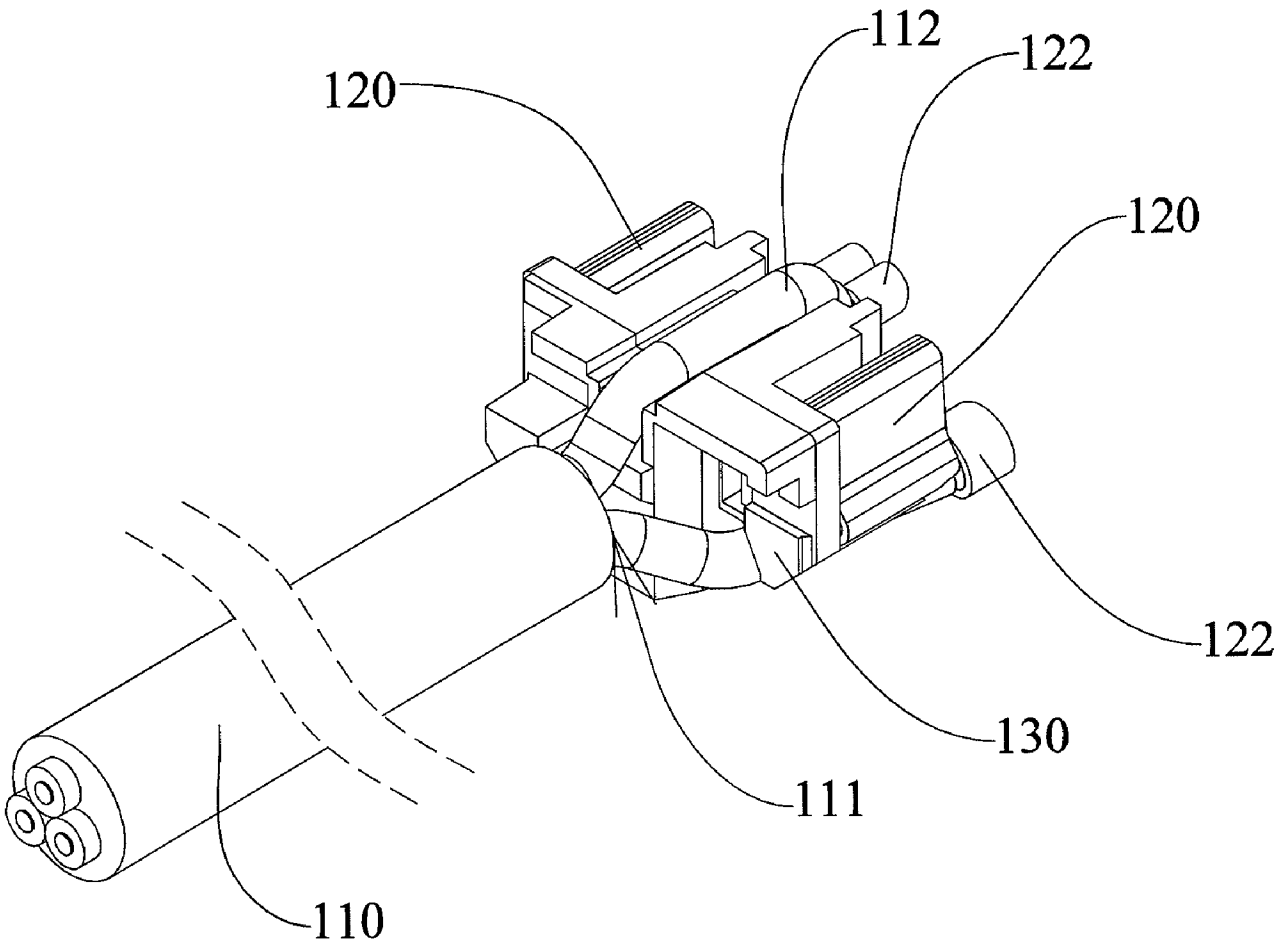

Assembling diagrams schematically illustrating a power connector structure according to one embodiment of the present invention are shown in FIG. 1, FIG. 2, FIG. 3, FIG. 4, FIG. 5 and FIG. 6. Referring to FIG. 1 first, a cable 110 includes a plurality of cores 112, wherein the cores 112 extend from a line end 111 of the cable 110 and each core 112 is provided with a terminal 120 electrically connected to each core 112. Each core 112 is covered by an insulating material while a portion of each core 112 about to be electrically connected to other components is excluded, such as a conducting wire 113 of the core 112. Each conducting wire 113 of the core 112 is electrically connected to an inner contact 122 of each terminal 120. As shown in FIG. 2, an inner holder structure 130 is disposed at the line end 111 of the cable 110 for fixing the cores 112 and providing electricity isolation among the terminals 120.

Figure 3:
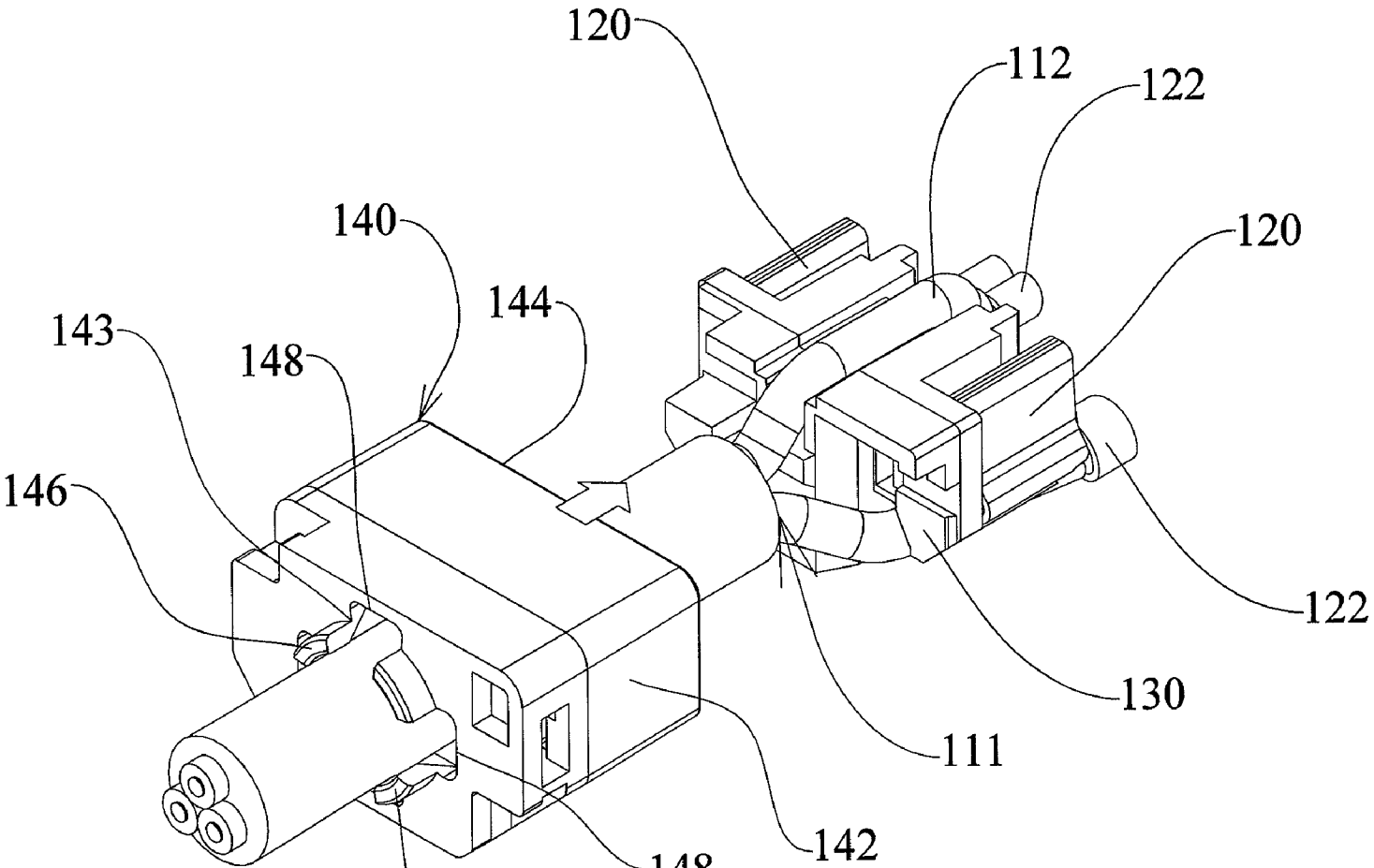
Figure 4:
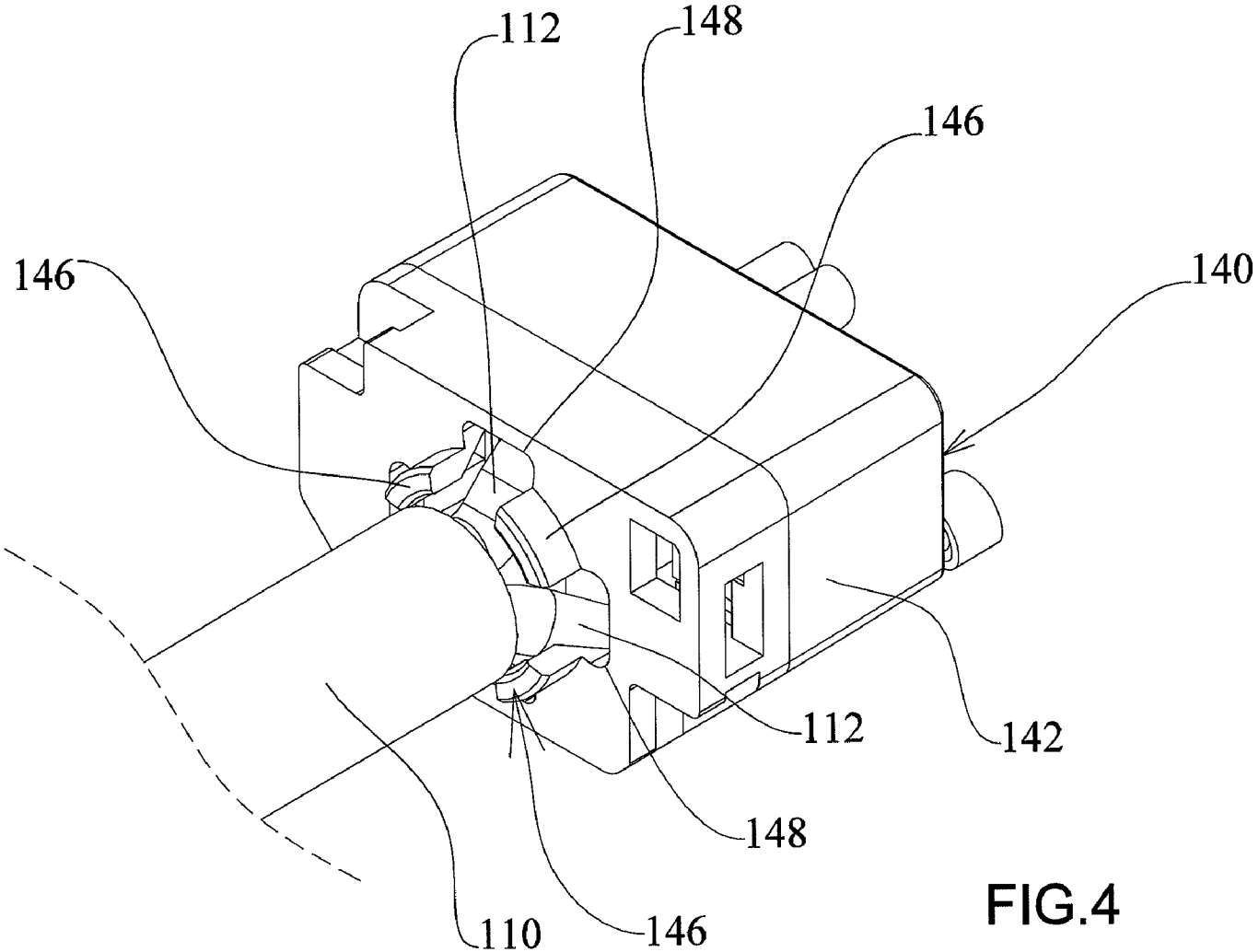

Referring to FIG. 3 and FIG. 4, an inner case 140 is configured for containing a partial of the cores 112 extending from the line end 111 of the cable 110, the terminals 120 and the inner holder structure 130, and an arrow in FIG. 3 indicates the assembling direction of the inner case 140 covering the terminals 120 and the inner holder structure 130. The inner case 140 includes a main body 142 and a plurality of out-extending positioned protrusions 146. As shown in FIG. 3, the main body 142 has a containing space with two side openings 143, 144 at both sides of the main body 142, wherein the inner holder structure 130 with the cores 112 and the terminals 120 disposed thereon is contained within the containing space. Inner contacts 122 of the terminals 120 are exposed to the side opening 144 of the main body 142. As shown in FIG. 3, the plurality of out-extending positioned protrusions 146 are disposed on the side opening 143 and extend outwards from the edge of the side opening 143 and towards the cable 110, wherein the out-extending positioned protrusions 146 are disposed between the cores 112 to separate the cores 112 from each other.

Still referring to FIG. 3 and FIG. 4, the embodiment according to the present invention further includes a plurality of positioned spaces 148 arranged on the side opening 143, wherein the positioned spaces 148 are separated from each other by each out-extending positioned protrusion 146 for containing the cores 112 and constraining the movement of the cores 112. In one embodiment, the inner holder structure 130 is engaged with the inner case 140. In another embodiment, the quantity of the positioned spaces 148 is more than or equal to that of the cores 112. In the embodiment shown in FIG. 3 and FIG. 4, there are four positioned spaces 148 substantially arranged in cross shape. It should be understood that the quantity of the positioned spaces 148 may be equal to that of the cores 112 in order to contain the cores 112.

Figure 5:
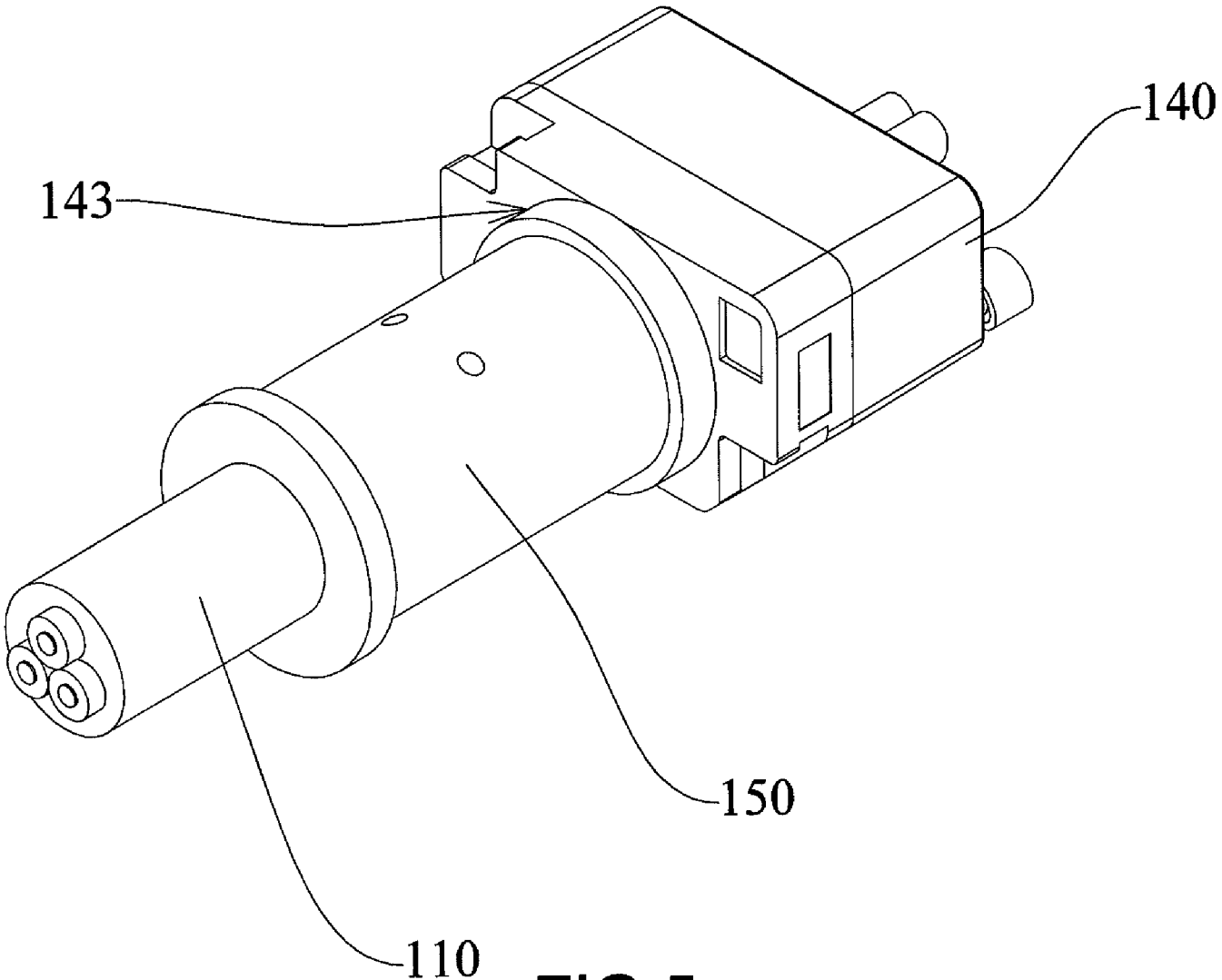
Figure 6:
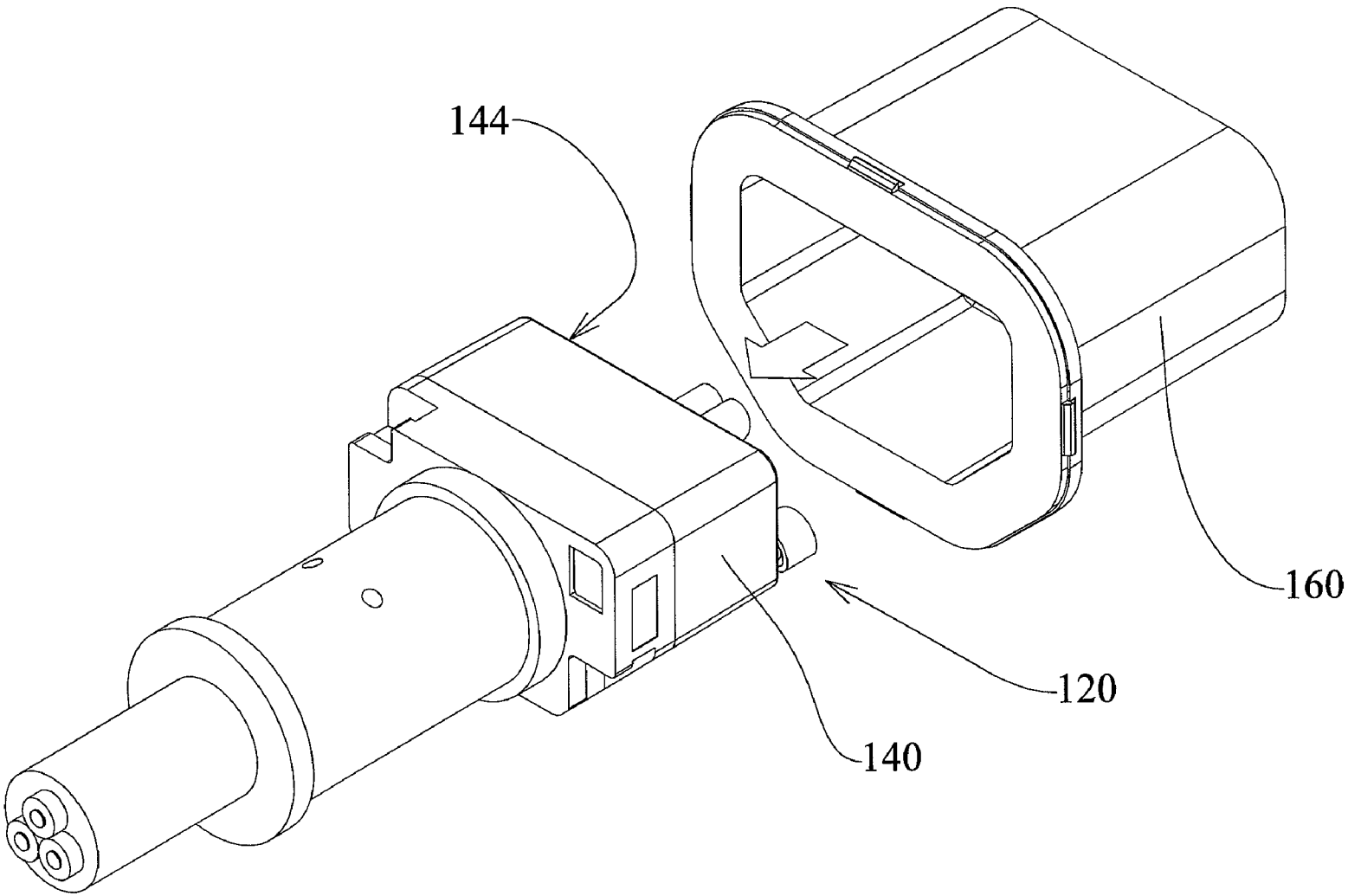
Figure 7:
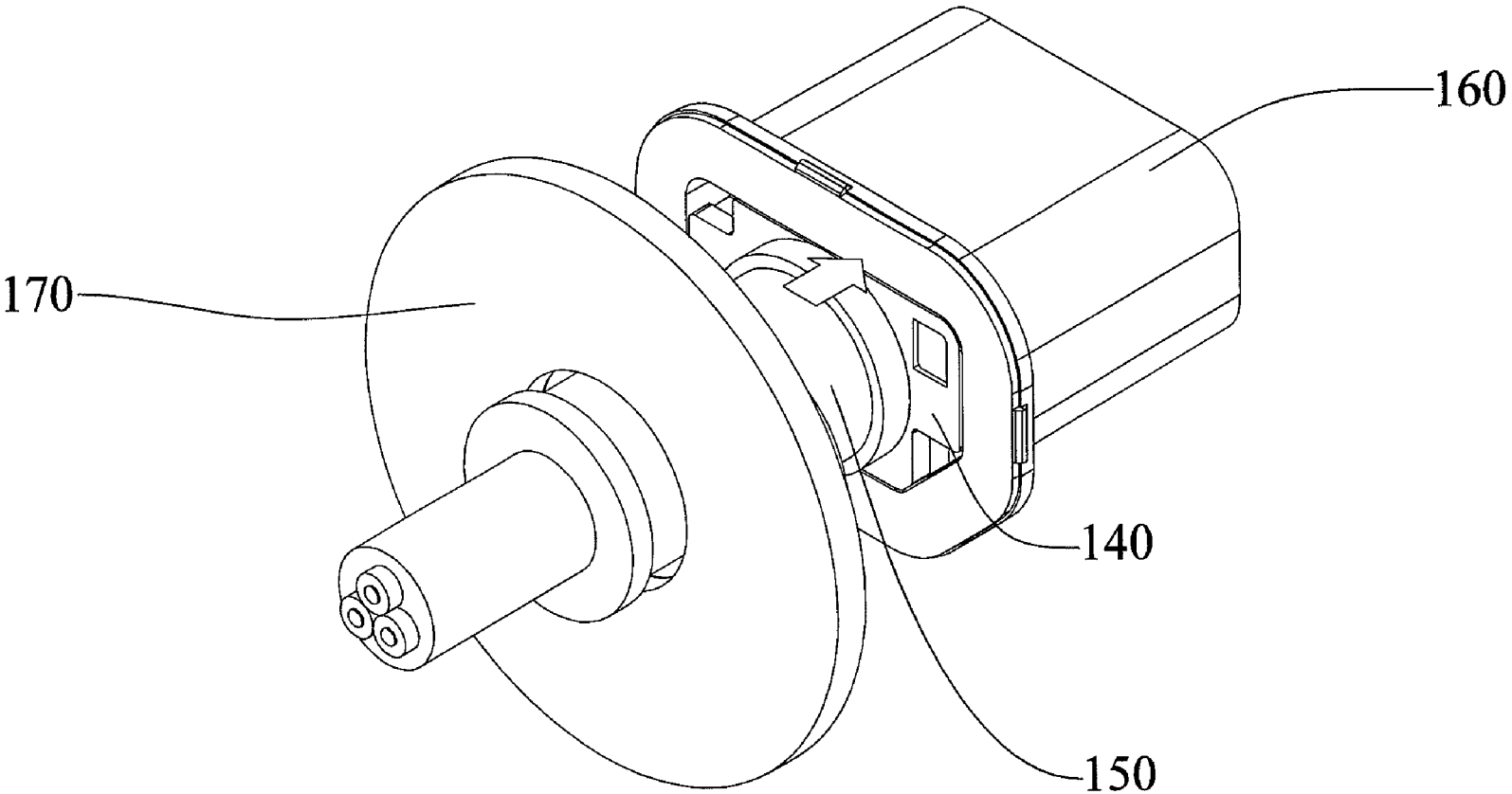

Referring to FIG. 5, a strain relief structure 150 is set on the side opening 143 of the inner case 140 via an appropriate method, such as insert molding, and substantially filled with the gap within the side opening 143. The out-extending positioned protrusions 146 and a portion of the cable 110 are covered by the strain relief structure 150. In one embodiment, the strain relief structure 150 is made of insulating materials. Referring to FIG. 6, an external cover 160 houses the inner case 140 by inserting the external cover 160 from the side opening 144 of the inner case 140 where the terminals 120 exposed, such as the direction of an arrow shown in FIG. 6. In another embodiment, as shown in FIG. 7, the power connector structure further includes an engaging ring 170, wherein the engaging ring 170 and the external cover 160 are engaged together to enclose the inner case 140, and an arrow in FIG. 7 indicates the assembling direction of the engaging ring 170 engaging with the external cover 160. In one embodiment, the inner case 140 can be, but not limited to further include a rough surface or an embossment formed on each out-extending positioned protrusion 146 for increasing the friction force between the inner case 140 and the strain relief structure 150. It should be understood that the shape or size of the out-extending positioned protrusions 146 may be variable within the principles of the invention.

Accordingly, the out-extending positioned protrusions formed in the inner case result in enhancing the bonding force between the inner case and the strain relief structure. Besides, the configuration of the out-extending positioned protrusions and the positioned spaces may prevent the cores from dislocation, and the quantity of the positioned spaces may be more than or equal to that of the cores.

In summary, the present invention provides a power connector structure utilizing the out-extending positioned protrusions to enhance the bonding force between the inner case and the strain relief structure to improve the reliability of the product.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A power connector structure comprising:

a cable having a plurality of cores, wherein said cores extend from a line end of said cable and each of said cores is provided with a terminal electrically connected thereto;

an inner holder structure disposed at said line end for fixing said cores and providing electricity isolation among said terminals;

an inner case configured for containing said cores extending from said line end and said terminals, wherein said inner case comprises:

a main body having a containing space with two side openings at both sides of said main body to receive said inner holder structure and said terminals, and a portion of said terminals are exposed to said main body; and a plurality of out-extending positioned protrusions disposed on said opening near said line end and extending outwards from the edge of said side opening and towards said cable, wherein said out-extending positioned protrusions are disposed between said cores to separate said cores from each other;

a strain relief structure set on said side opening near said line end and substantially filled with the gap within said side opening, wherein said out-extending positioned protrusions are covered by said strain relief structure; and an external cover housing said inner case.

2. The power connector structure according to claim 1, further comprising an engaging ring, wherein said engaging ring and said external cover are engaged together to enclose said inner case.

3. The power connector structure according to claim 1, further comprising a rough surface or an embossment formed on each of said out-extending positioned protrusions.

4. The power connector structure according to claim 1, wherein said inner holder structure is engaged with said inner case.

5. The power connector structure according to claim 1, wherein said main body further comprises a plurality of positioned spaces arranged on said side opening near said line end and said positioned spaces are separated from each other by each of said out-extending positioned protrusions for containing said cores and constraining the movement of said cores.

6. The power connector structure according to claim 5, wherein the quantity of said positioned spaces is more than or equal to that of said cores.

* * * * *